US010215392B2

(12) United States Patent
Gebhard et al.

(10) Patent No.: US 10,215,392 B2
(45) **Date of Patent: *Feb. 26, 2019**

(54) LED SYSTEM AND HOUSING FOR USE WITH HALOGEN LIGHT FIXTURES

(71) Applicant: Golight, Inc., Culbertson, NE (US)

(72) Inventors: Albert W. Gebhard, Denver, CO (US); Colton D. Hosick, Culbertson, NE (US)

(73) Assignee: Golight, Inc., Culbertson, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/818,289

(22) Filed: Nov. 20, 2017

(65) Prior Publication Data

US 2018/0073717 A1 Mar. 15, 2018

Related U.S. Application Data

(63) Continuation of application No. 15/223,381, filed on Jul. 29, 2016, now Pat. No. 9,822,961, which is a (Continued)

(51) Int. Cl.
*F21V 5/00* (2018.01)
*F21V 29/74* (2015.01)
(Continued)

(52) U.S. Cl.
CPC ..... *F21V 29/74* (2015.01); *F21S 45/47* (2018.01); *F21V 5/045* (2013.01); *F21V 15/01* (2013.01);
(Continued)

(58) Field of Classification Search
CPC ..... F21V 29/74; F21V 5/045; F21V 15/01; F21S 48/328
See application file for complete search history.

(56) References Cited

U.S. PATENT DOCUMENTS 3,049,615 A 8/1962 Sawyer
3,784,809 A 1/1974 Smith
(Continued)

FOREIGN PATENT DOCUMENTS

AU 2008100403 A4 6/2008
KR 10-0949122 B1 3/2010
(Continued)

OTHER PUBLICATIONS

U.S. Appl. No. 15/223,381, filed Jul. 29, 2016, inventors Gebhard et al.
(Continued)

*Primary Examiner* — Ali Alavi
(74) *Attorney, Agent, or Firm* — Polson Intellectual Property Law P.C.; Margaret Polson; Christopher R. Sylvain

(57) ABSTRACT

An LED optical light engine spotlight which can accommodate a variable number of light-emitting diodes (LEDs) is disclosed. An optical projection lens mounted in front of the LEDs merges the separate LED beams into a single beam, similar to the single beam provided by a halogen light and reflector. A heat sink provides convection cooling up to approximately 100° F. An optional fan provides additional heat dissipation for more extreme conditions. The depicted device can include a vertical tilt of over 200°. Optimally, the depicted device is designed to have a full vertical tilt range between zenith (0 degrees) to horizontal (90 degrees) to full depression (135 degrees). An optional accessory lens provides additional capabilities, including flood lenses, colored lenses and rock guards, for example. The depicted device can be hard wired or wireless. The depicted device can be adapted to many base units and/or pan and tilt platforms.

20 Claims, 13 Drawing Sheets

Related U.S. Application Data continuation of application No. 14/152,908, filed on Jan. 10, 2014, now Pat. No. 9,605,843, which is a continuation-in-part of application No. 14/130,099, filed as application No. PCT/US2012/046312 on Jul. 11, 2012, now Pat. No. 9,255,687.

(60) Provisional application No. 61/506,594, filed on Jul. 11, 2011, provisional application No. 61/561,162, filed on Nov. 17, 2011.

(51) Int. Cl.

| | |
|---|---|
| ***F21V 29/02*** | (2006.01) |
| ***F21V 29/83*** | (2015.01) |
| ***F21V 15/01*** | (2006.01) |
| ***F21V 23/00*** | (2015.01) |
| ***F21V 29/507*** | (2015.01) |
| ***F21V 29/76*** | (2015.01) |
| ***F21V 29/67*** | (2015.01) |
| ***F21V 5/04*** | (2006.01) |
| ***F21V 31/00*** | (2006.01) |
| ***F21S 45/47*** | (2018.01) |
| *F21W 102/00* | (2018.01) |
| *F21V 21/30* | (2006.01) |
| *F21Y 101/00* | (2016.01) |
| *F21Y 105/10* | (2016.01) |
| *F21Y 115/10* | (2016.01) |

(52) U.S. Cl.

CPC ..... *F21V 23/003* (2013.01); *F21V 23/006* (2013.01); *F21V 23/007* (2013.01); *F21V 29/02* (2013.01); *F21V 29/507* (2015.01); *F21V 29/67* (2015.01); *F21V 29/76* (2015.01); *F21V 29/763* (2015.01); *F21V 29/83* (2015.01); *F21V 31/005* (2013.01); *F21V 21/30* (2013.01); *F21W 2102/00* (2018.01); *F21Y 2101/00* (2013.01); *F21Y 2105/10* (2016.08); *F21Y 2115/10* (2016.08)

(56) References Cited

U.S. PATENT DOCUMENTS

| | | | | |
|---|---|---|---|---|
| 3,936,670 | A | 2/1976 | Allen, Sr. | |
| 4,124,880 | A | 11/1978 | Dart et al. | |
| 4,535,110 | A | 8/1985 | Iseler et al. | |
| 4,598,345 | A | 7/1986 | Kleeman | |
| 4,779,168 | A | 10/1988 | Montgomery | |
| 4,890,207 | A | 12/1989 | Jones | |
| 5,385,062 | A | 1/1995 | Menke | |
| 5,490,046 | A | 2/1996 | Gohl et al. | |
| 5,499,167 | A | 3/1996 | Brown | |
| 5,517,388 | A | 5/1996 | Hutchisson | |
| 5,584,560 | A | 12/1996 | Gosswiller et al. | |
| 5,673,989 | A | 10/1997 | Gohl et al. | |
| 5,697,691 | A | 12/1997 | Menke | |
| 5,782,555 | A | 7/1998 | Hochstein | |
| 5,785,418 | A | 7/1998 | Hochstein | |
| 5,806,956 | A | 9/1998 | Hyun-Jo | |
| 5,857,767 | A * | 1/1999 | Hochstein | F21S 48/328 362/294 |
| 6,045,240 | A * | 4/2000 | Hochstein | B60Q 1/2696 362/249.06 |
| 6,146,000 | A | 11/2000 | Holzl et al. | |
| 6,183,100 | B1 | 2/2001 | Suckow et al. | |
| 6,428,189 | B1 | 8/2002 | Hochstein | |
| 6,461,009 | B2 | 10/2002 | Smith | |
| 6,517,218 | B2 * | 2/2003 | Hochstein | F21S 48/215 257/712 |
| 6,955,447 | B2 | 10/2005 | Lui | |
| 6,979,104 | B2 | 12/2005 | Brass et al. | |
| D515,228 | S | 2/2006 | Gebhard et al. | |
| D528,678 | S | 9/2006 | Yen | |
| 7,204,606 | B2 | 4/2007 | Brass et al. | |
| D552,781 | S | 10/2007 | Kosche et al. | |
| 7,301,346 | B2 | 11/2007 | Annighoefer et al. | |
| 7,302,181 | B2 | 11/2007 | Ng et al. | |
| D582,084 | S | 12/2008 | Gebhard et al. | |
| 7,461,944 | B2 | 12/2008 | Alessio | |
| 7,568,816 | B2 | 8/2009 | Brass et al. | |
| D606,691 | S | 12/2009 | Lindholm | |
| 7,798,667 | B2 | 9/2010 | Klipstein | |
| D625,870 | S | 10/2010 | Feigenbaum | |
| 7,891,834 | B2 | 2/2011 | Alessio | |
| 7,938,556 | B2 | 5/2011 | Dahlin | |
| D645,594 | S | 9/2011 | Grawe | |
| 8,066,402 | B2 | 11/2011 | Klipstein | |
| D650,505 | S | 12/2011 | Oka | |
| D660,506 | S | 5/2012 | McMahan | |
| 8,172,430 | B2 | 5/2012 | Alessio | |
| D666,346 | S | 8/2012 | Gebhard et al. | |
| 8,348,463 | B2 | 1/2013 | Murai et al. | |
| D679,446 | S | 4/2013 | Harrington, Jr. | |
| D692,168 | S | 10/2013 | Harrington, Jr. | |
| D693,509 | S | 11/2013 | Hosick et al. | |
| 8,928,226 | B1 | 1/2015 | Harrington, Jr. | |
| 9,255,687 | B2 | 2/2016 | Gebhard et al. | |
| 9,327,640 | B2 | 5/2016 | Harrington, Jr. | |
| 9,506,617 | B2 | 11/2016 | Harrington, Jr. | |
| 9,599,563 | B2 | 3/2017 | Brass et al. | |
| 9,605,843 | B2 * | 3/2017 | Gebhard | F21V 29/02 |
| 9,822,961 | B2 * | 11/2017 | Gebhard | F21V 29/74 |
| 2004/0037064 | A1 | 2/2004 | Johnson | |
| 2005/0117347 | A1 | 6/2005 | Melpignano et al. | |
| 2007/0076413 | A1 * | 4/2007 | Mingozzi | F21V 29/004 362/249.01 |
| 2007/0127252 | A1 | 6/2007 | Fallahi et al. | |
| 2008/0089060 | A1 | 4/2008 | Kondo et al. | |
| 2008/0175003 | A1 * | 7/2008 | Tsou | F21S 48/328 362/294 |
| 2009/0003009 | A1 * | 1/2009 | Tessnow | F21S 48/1154 362/487 |
| 2010/0014278 | A1 | 1/2010 | Thomas et al. | |
| 2010/0014289 | A1 * | 1/2010 | Thomas | F21V 15/01 362/235 |
| 2010/0020548 | A1 * | 1/2010 | Tyson | F21V 31/005 362/321 |
| 2010/0038170 | A1 | 2/2010 | Einhaus | |
| 2011/0019416 | A1 | 1/2011 | Poissonnet et al. | |
| 2011/0103059 | A1 | 5/2011 | Chen et al. | |
| 2011/0110087 | A1 | 5/2011 | Hochstein | |
| 2011/0114976 | A1 | 5/2011 | Hochstein | |
| 2011/0273879 | A1 * | 11/2011 | Hochstein | F21V 29/004 362/235 |
| 2012/0162983 | A1 | 6/2012 | Pickholz | |
| 2014/0376005 | A1 | 12/2014 | Aoki | |

FOREIGN PATENT DOCUMENTS

| | | |
|---|---|---|
| KR | 10-0131759 A | 12/2010 |
| WO | 2010069327 A1 | 6/2010 |

OTHER PUBLICATIONS

Cliplight catalog, 2007. Products shown are admitted prior art by applicant.

* cited by examiner

LED SYSTEM AND HOUSING FOR USE WITH HALOGEN LIGHT FIXTURES

CROSS REFERENCE APPLICATIONS

This application is a continuation of application Ser. No. 14/152,908 filed Jan. 10, 2014, which is a continuation-in-part of prior PCT Application No. -PCT/US12/46312, filed Jul. 11, 2012, which is a non-provisional application claiming the benefits of provisional application no. 61/506,594 filed Jul. 11, 2011 and provisional application no. 61/561,162 filed Nov. 17, 2011, the disclosures of each of which are hereby incorporated by reference for all purposes.

BACKGROUND

Lighting systems and housings are well known in the art. These prior art housings suffer from a number of drawbacks. Halogen systems provide a single beam of light useful for illuminating large areas (flood) or as a spot. However, halogen lights are fragile and require replacement often which is troublesome and often dangerous. Halogen lamps burn excessively hotter than many other types of lamp. Light emitting diodes (LEDs) burn at a lower temperature and last longer, but fail to provide the intense, single beam illumination of a halogen light with a spot reflector. Halogen lights and LEDs are also disparate in size, making it impossible to simply replace a halogen spot light with an LED. Because of the difference in illumination provided by a halogen light and an LED, such a substitution would also fail to provide the same amount of light.

The foregoing example of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

The disclosed lamp housing is designed to accommodate a variable number of light-emitting diodes (LEDs). A projection lens mounted in front of the LEDs merges the separate beams from the LEDs into a single beam, similar to the single beam provided by a halogen light. The LED mounting system allows the LEDs to be placed in a space originally designed for a single halogen lamp. The depicted device can include a vertical tilt between zenith (0 degrees) to horizontal (90 degrees) to full depression (135 degrees). An optional accessory lens provides additional capabilities, including flood lenses which convert spot performance to flood, colored lenses and rock guards, for example. The depicted device can be hard wired or wireless. The depicted device can be adapted to many base units and/or pan and tilt platforms.

This LED complete light engine is a plug and play replacement for a halogen unit with reflector resulting in similar beam performance without the drawbacks of a halogen unit. The disclosed device has a simple and weatherproof design, which allows for easy assembly and maintenance. The disclosed device provides improved durability and weather resistance.

In addition to the exemplary aspects and embodiments described above, further aspects and embodiments will become apparent by reference to the accompanying drawings forming a part of this specification wherein like reference characters designate corresponding parts in the several views.

BRIEF DESCRIPTION OF THE DRAWINGS

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 1:
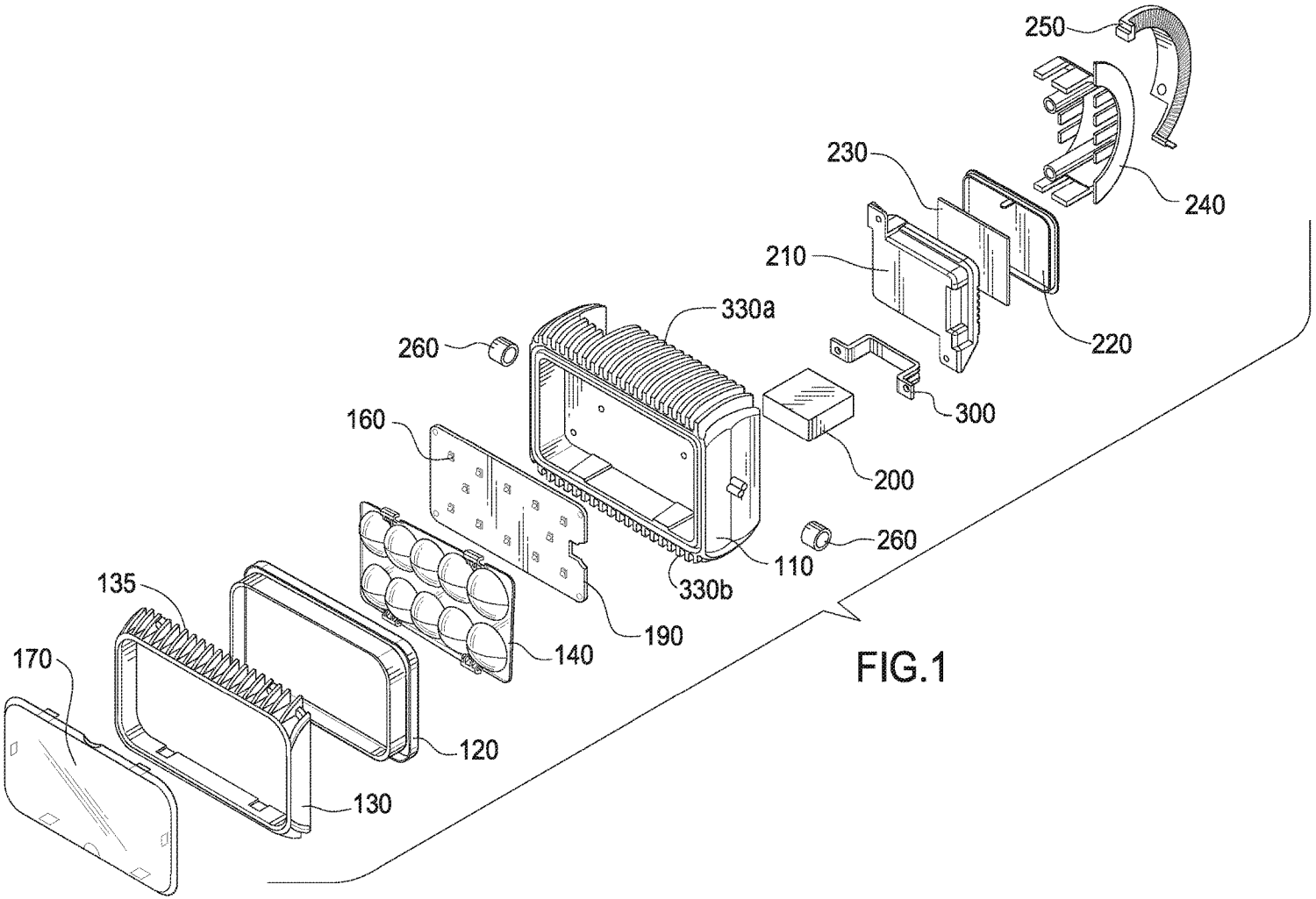
FIG. 1 is an exploded view of one embodiment of a light engine assembly of the present application.
Figure 6:
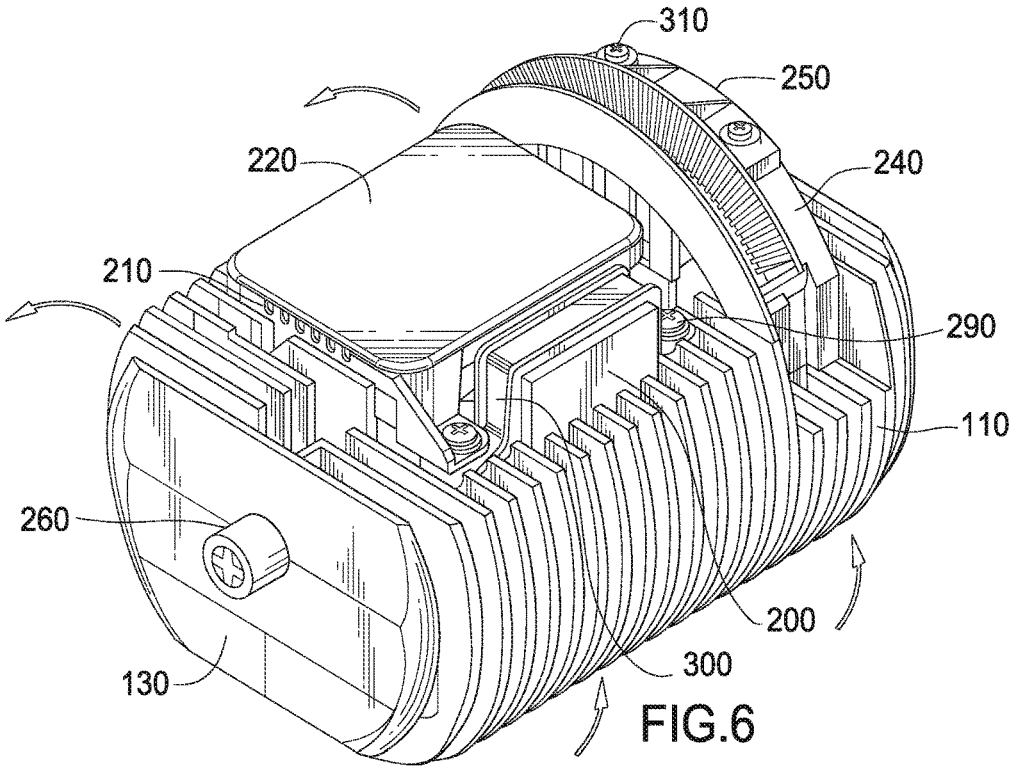
FIG. 6 is a back perspective view of FIG. 2.
Figure 7:
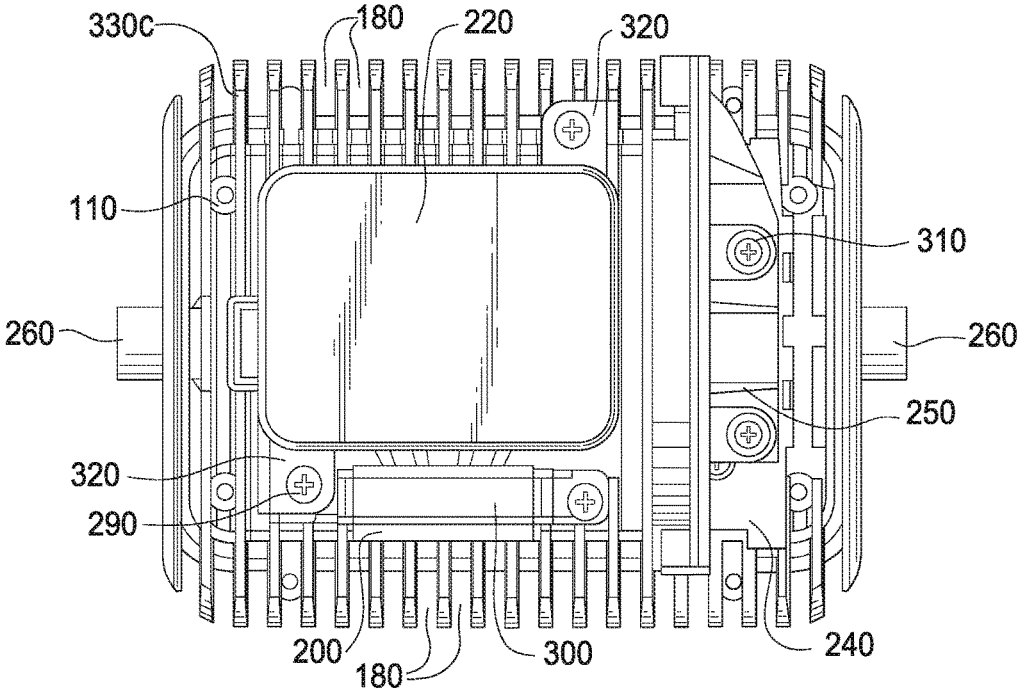
FIG. 7 is a back side elevation view of FIG. 2.

FIG. 1 is an exploded view of light assembly 100. This figure depicts an optional accessory lens 170, which, if present, mounts to bezel 130. Accessory lens 170 can serve a variety of functions, including flood lens, color lens, or rock guard. Heat sink 110 includes a number of cooling fins 330, which radiate from the top and bottom of heat sink 110. The design of the heat sink must be carefully tuned to the LEDs and their requirements for heat dissipation. In use, heat created by LEDs 160 is dissipated through cooling fins 330. Protective lens 120 attaches to heat sink 110 with silicone, thereby hermetically sealing the parts sandwiched in between. These intervening parts include LEDs 160, which are mounted in printed circuit board (PCB) 190. Projection lens 140 is mounted over PCB 190. In use, projection lens 140 will focus the individual beams of light from LEDs 160 into a single beam of light which can illuminate a large area, much like a halogen light. Bezel 130 is mounted over protective lens 120 and attaches to heat sink 110. Bezel 130 includes cooling fins 135 on the top and bottom as seen in FIG. 3. When bezel 130 is attached to heat sink 110, air enters at the bottom of bezel 130 through cooling fins 135*b* and travels over cooling fins 330*b* at the base of heat sink 110, along cooling fins 330*c* on the back of the heat sink and then up over cooling fins 330*a* on the top of heat sink 310 and exits over cooling fins 135*a*, allowing for convection and air cooling. The direction of air flow is represented by arrows in FIGS. 2 and 6. In the depicted embodiment the cooling fins of the bezel 130 and the heat sink 110 are aligned so that air channels 180 are formed as seen in FIG. 7. In the depicted embodiment, the air channels 180 are on at least three surfaces of the light housing, top, back and bottom. This creates airflow over at least these three surfaces to help efficiently cool the light. This convection and air cooling will be more pronounced if an optional fan 200 is included.

In the depicted embodiment, heat sink 110 comprises aluminum and is created from a cast. Those skilled in the art will understand that metal is selected for its heat dissipation properties. One having an ordinary level of skill in the art will understand that any material having similar properties to aluminum could be used. The figures depict 10 LEDs, however, one skilled in the art will understand that a variable number of LEDs could be provided. In the depicted embodiment, projection lens 140 is made of acrylic, and is molded as a single piece. In an alternative embodiment, projection lens 140 may comprise acrylic. In the depicted embodiment, a silicone pad connects PCB 190 to heat sink 110. Silicone provides excellent heat transfer to assist in the convection cooling of LEDs 160. Those having an ordinary level of skill in the art will understand that other materials having similar properties to silicone could be used, and that multiple lenses could be manufactured and later attached to one another or to the PCB. In the depicted embodiment, the LEDs are Luxeon star LEDs. A person having ordinary skill in the art will understand that other brands and types of LEDs could be substituted for Luxeon LEDs. In the depicted embodiment, bezel 130 is made of plastic. A person having ordinary skill in the art will understand that any material having similar properties to plastic could be used to form the bezel.

Turning next to the mechanical components behind heat sink 110, an optional fan 200 is mounted to the bottom side of heat sink 110 opposite LEDs 160. A clamp 300 attaches fan 200 to heat sink 110. In the depicted embodiment, fan 200 is water resistant. Convection cooling of the LEDs is sufficient for temperatures up to approximately 100° F. Fan 200 can be installed for more extreme conditions, such as temperatures greater than 100° F. Front case 210 and back case 220 enclose driver 230. Back case 220 is wired to LEDs 160 and a power input (not shown). In the depicted embodiment, driver 230 comprises PCB and provides between approximately 10 to 30 volts of power to the LEDs. Those having ordinary skill in the art will understand that cost and location considerations will likely be primary considerations in the decision to use one driver or multiple drivers. A support 240 is mounted behind heat sink 110. Support 240 holds tilt gear 250 in place. The location of tilt gear 250 in the depicted embodiment is merely exemplary. Tilt gear 250 could be mounted in various positions in light assembly 100 and still be within the scope of the present disclosure. In the depicted embodiment, support 240 comprises plastic. A person having an ordinary level of skill in the art will understand that any material having similar properties to plastic could be substituted.

Figure 2:
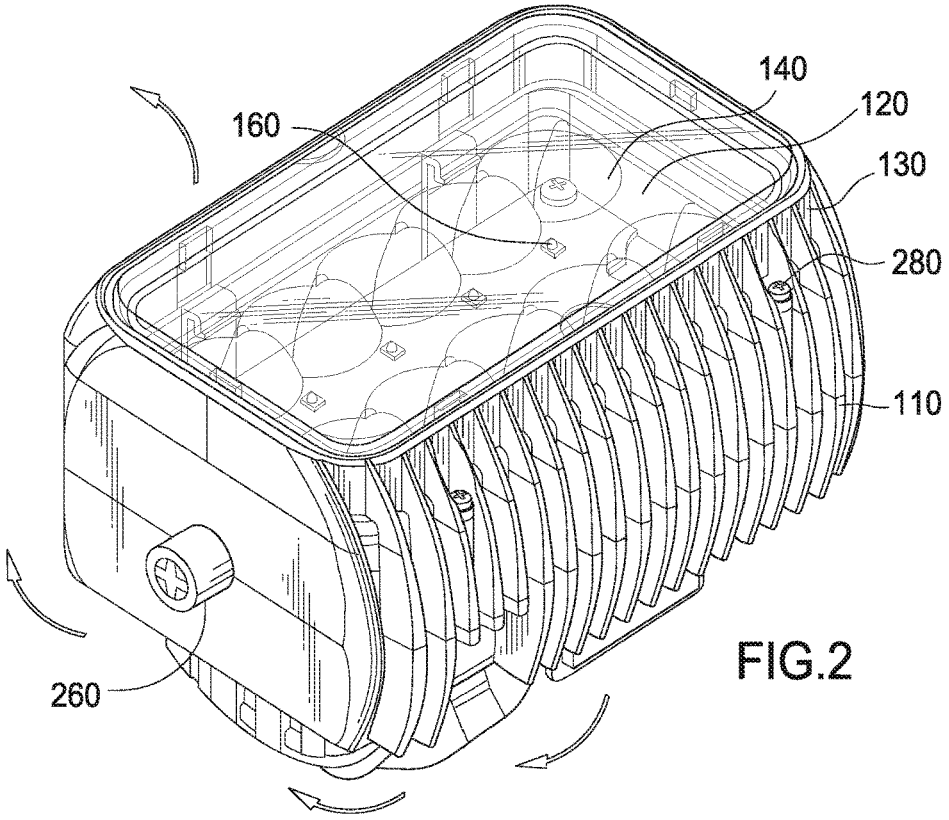
FIG. 2 is a front perspective view of the LED lamp of FIG. 1 without the pan and tilt platform.
Figure 3:
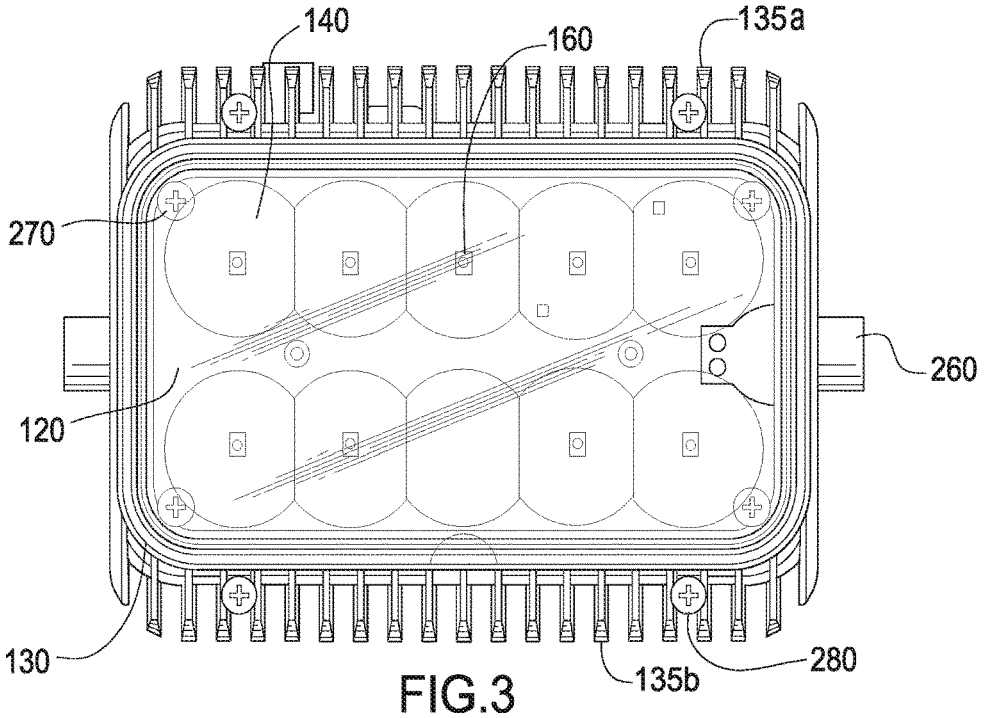
FIG. 3 is a front side elevation view of FIG. 2.

Turning next to FIGS. 2-9, the LED system is shown assembled, but without a cover. In FIG. 2, heat sink 110, bezel 130, protective cover 120, projection lens 140 and LEDs 160 remain visible. Bearings 260 are now visible. Bearings 260 attach to heat sink 110 and allow the unit to tilt vertically. Bearings 260 also reduce wear and add lubricity to pivot points.

FIG. 3 shows all of the foregoing parts, and also displays screws 270, which are used to attach PCB 190 to heat sink 110. A second set of screws 280 attaches bezel 130 to heat sink 110. While screws are depicted, one skilled in the art will understand that any number of fasteners could be used and still remain within the scope of the present disclosure.

Figure 4:
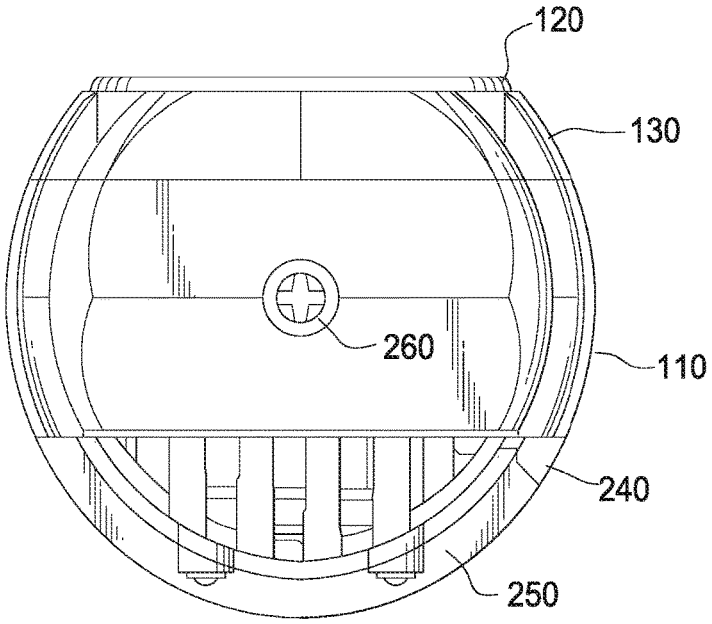
FIG. 4 is a left side elevation view of FIG. 2.
Figure 5:
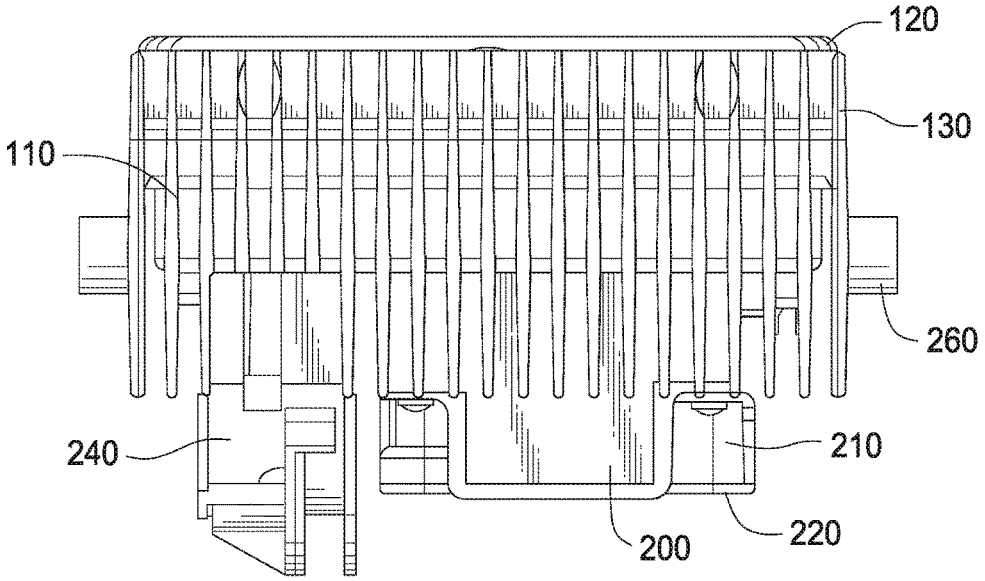
FIG. 5 is a bottom plan view of FIG. 2.

In FIG. 4, support 240 and tilt gear 250 are partially visible. FIG. 5 shows the bottom of fan 200, front cover 210 and back cover 220. In FIG. 6, front case 210 and back case 220 are visible. From this view, screws 290 can be seen attaching clamp 300 and front case 210 to heat sink 110. Another set of screws 310 attaches tilt gear 250 to heat sink 110 through support 240. While screws are depicted, one skilled in the art will understand that any number of fasteners could be used and still remain within the scope of the present disclosure.

Figure 8:
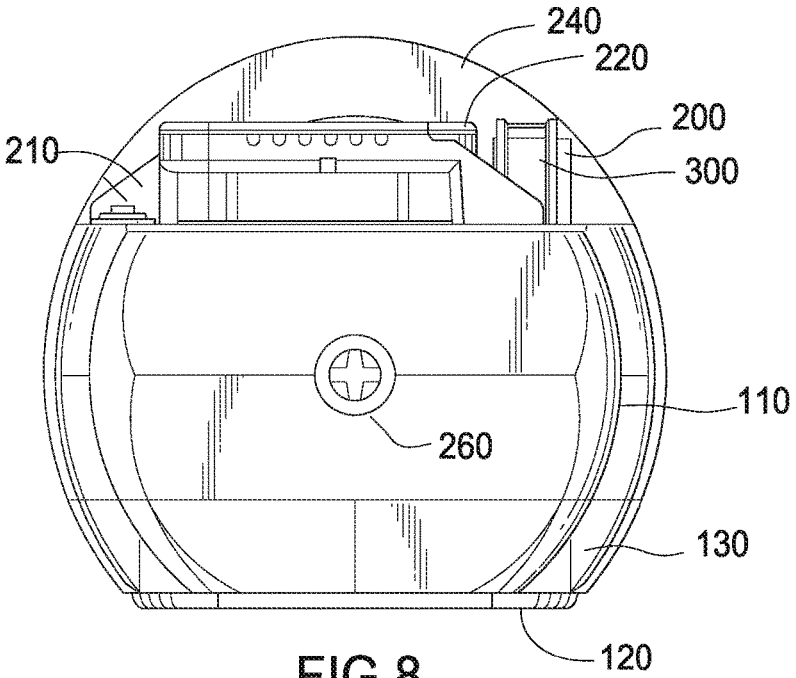
FIG. 8 is a right side elevation view of FIG. 2.
Figure 9:
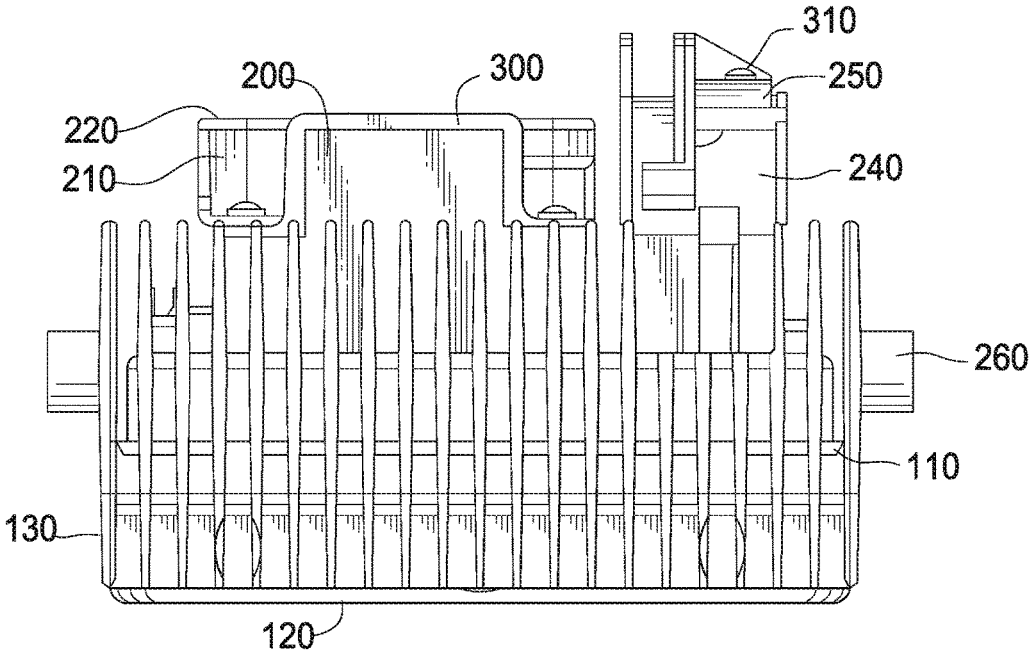
FIG. 9 is a rotated bottom plan view of FIG. 2.

FIG. 7 shows legs 320 extending from front case 210, through which screws 290 attach to heat sink 110. FIGS. 8 and 9 show the components from the remaining angles to provide a fully 3 dimensional view of the LED system.

Figure 10:
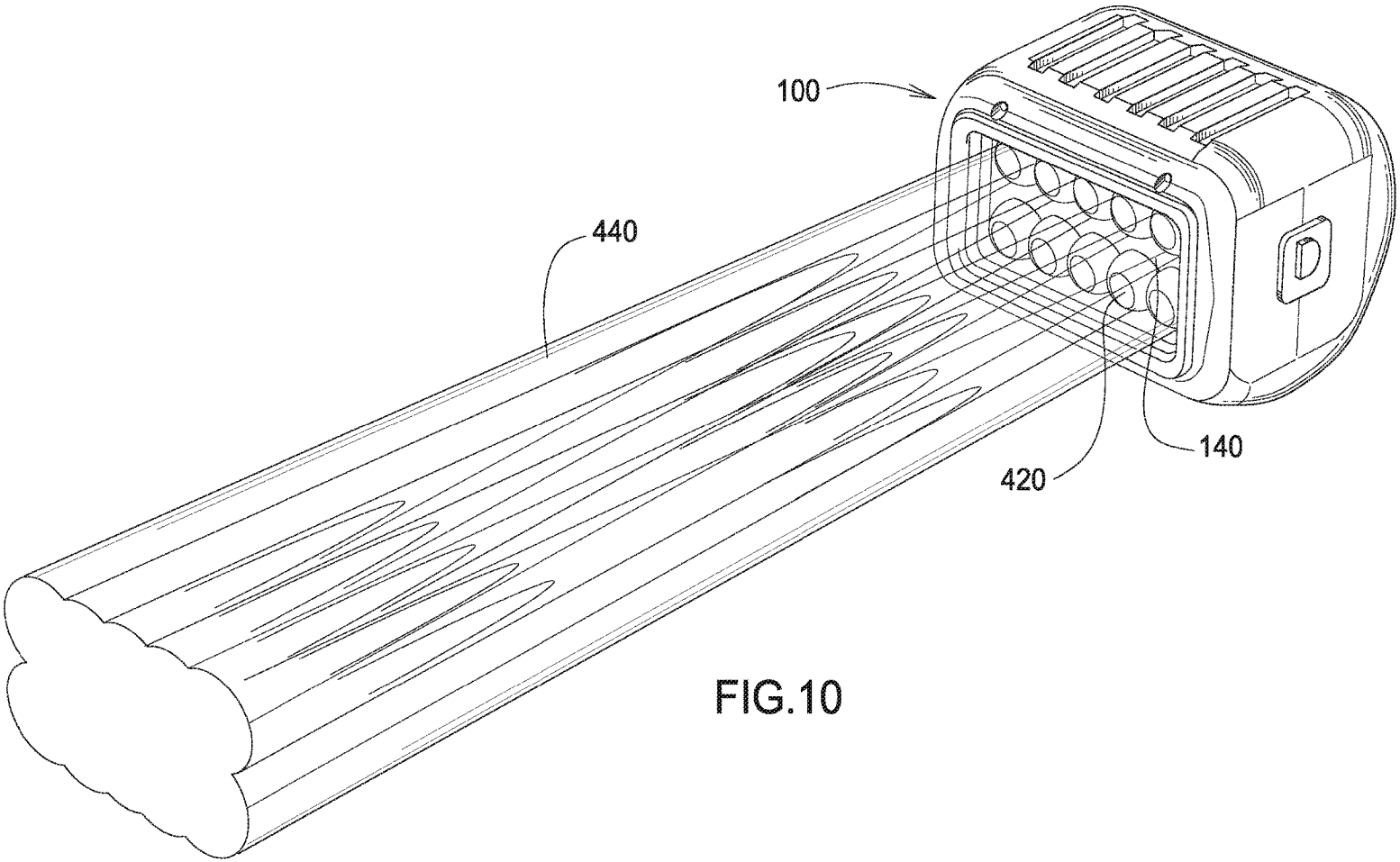
FIG. 10 is a front perspective view of a beam pattern of one embodiment of a lens of the present application.

FIG. 10 is a front perspective view of light assembly 100. Light assembly 100 includes projection lens 140 that places multiple optical projections lenses in series with one another. Projection lens 140 includes a series of protrusions 420. Protrusions 420 are semi-spherical in shape. Protrusions 420 are designed to be mounted over LEDs 160 such that each LED 160 is approximately centered within a protrusion 420. This arrangement maximizes the benefits of protrusions 420. In use, each protrusion 420 will focus the individual beams of light 440 from LEDs 160 to converge into a single beam of light which can illuminate a large area, much like a halogen light. The figures depict 10 LEDs, however, one skilled in the art will understand that a variable number of LEDs could be provided. In the depicted embodiment, optical lens 410 is made of acrylic, and is molded as a single piece containing multiple optical projection lenses in series. In the depicted embodiment, the LEDs are Luxeon star LEDs. A person having ordinary skill in the art will understand that other brands and types of LEDs could be substituted for Luxeon LEDs.

Figure 11:
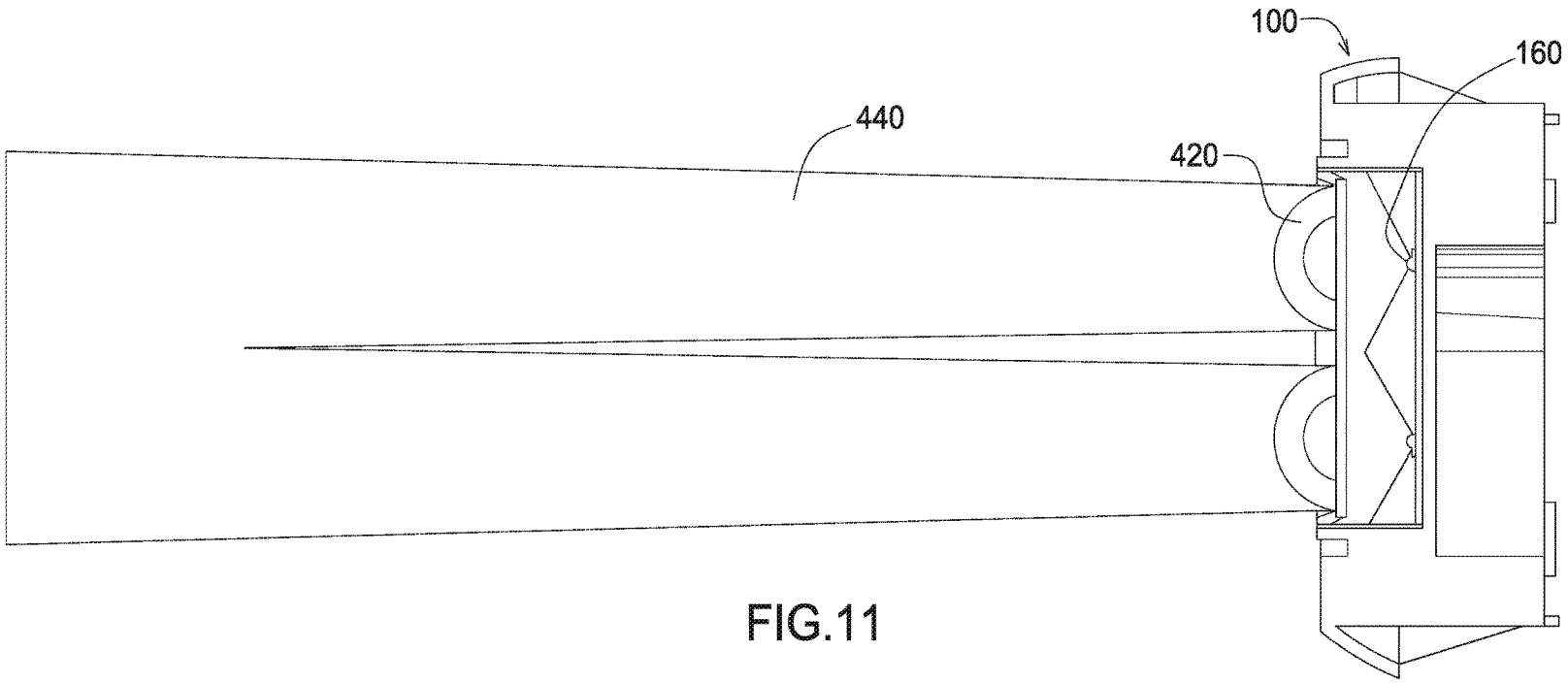
FIG. 11 is a top plan view of FIG. 10.

Turning next to FIG. 11, a top plan view of light assembly 100 is shown. From this perspective, the effect of projection lens 140 on the beams of light from LEDs 160 can be seen. The shape of protrusions 420 causes the beams of light 440 from LEDs 160 to become more concentrated. The spacing and location of protrusions 420 on projection lens 140 causes the beams of light 440 to converge, providing illumination similar to that provided by a single halogen light. The exact spacing will depend on the size of projection lens 140 and the number of LEDs.

Figure 12:
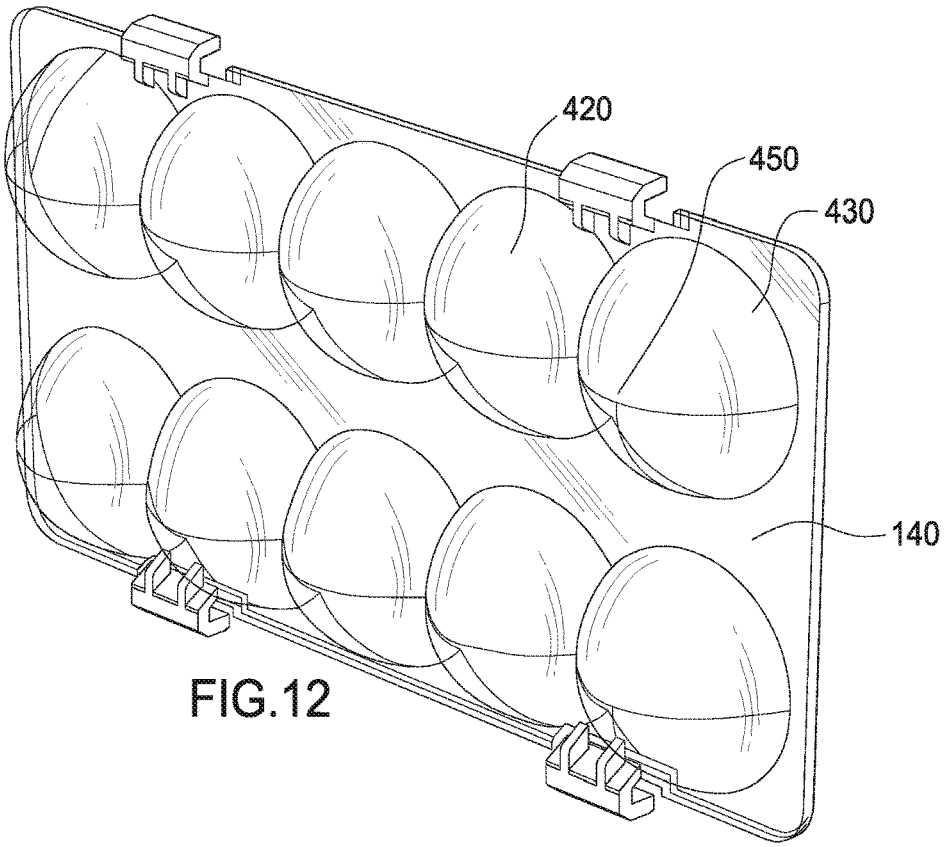
FIG. 12 is a perspective view of a lens according to the present application.

FIG. 12 shows projection lens 140 without light assembly 100.

Figure 13:
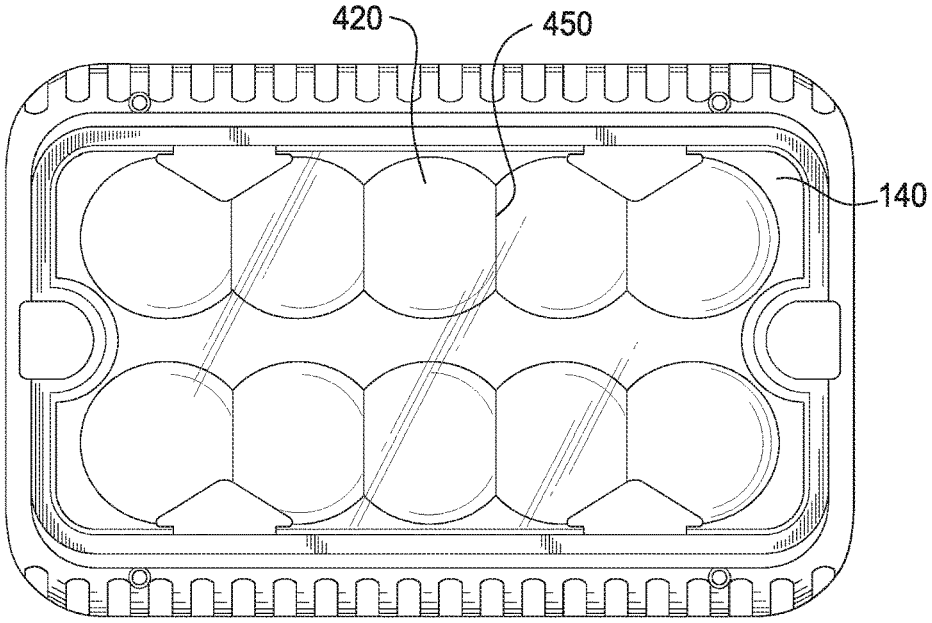
FIG. 13 is a front plan view of a lens according to the present application.

FIG. 13 is a front plan view of projection lens 140. From this perspective, protrusions 420 are shown to have flattened edges 450 where two protrusions 420 meet. The flattened edges allow the protrusions 420 to be placed closer together. This is useful when it is desired to get the largest number of possible LEDs in a small space. Each protrusion 420 is shaped to focus its beam of light such that the beams of light converge.

Figure 14:
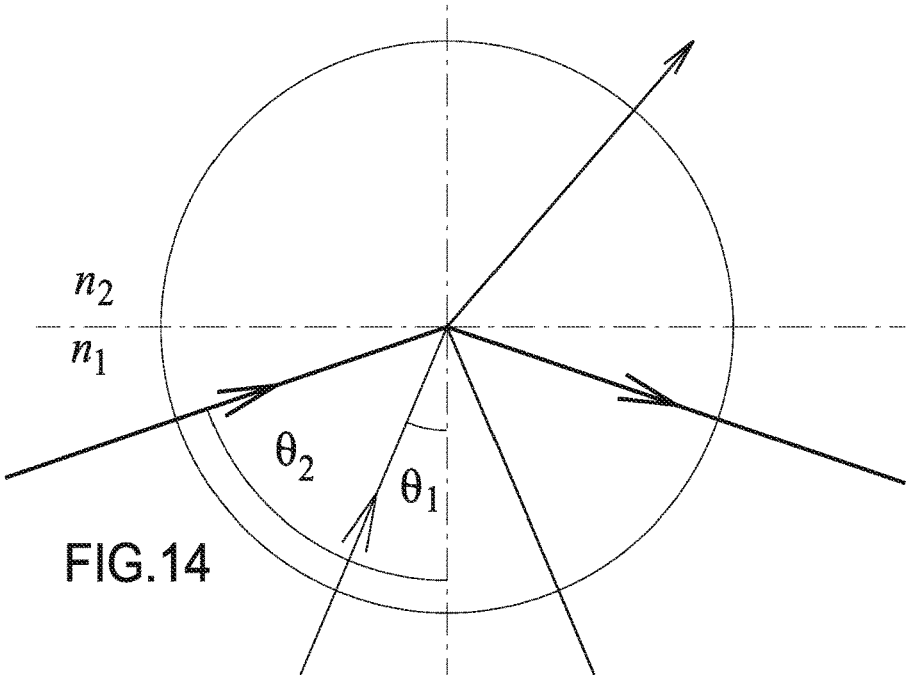
FIG. 14 is a diagram representing refraction and total internal reflection.
Figure 15:
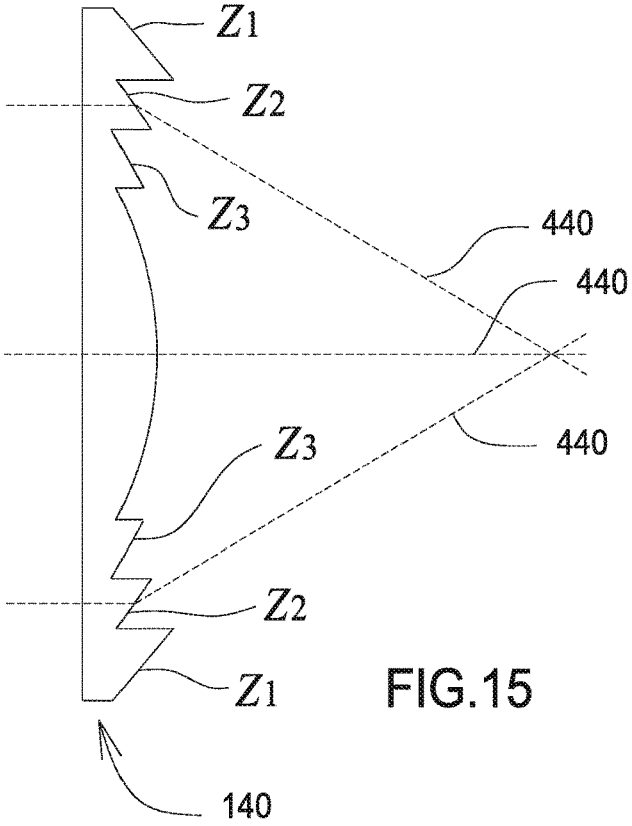
FIG. 15 is a left or right side plan view of a Fresnel lens.
Figure 16:
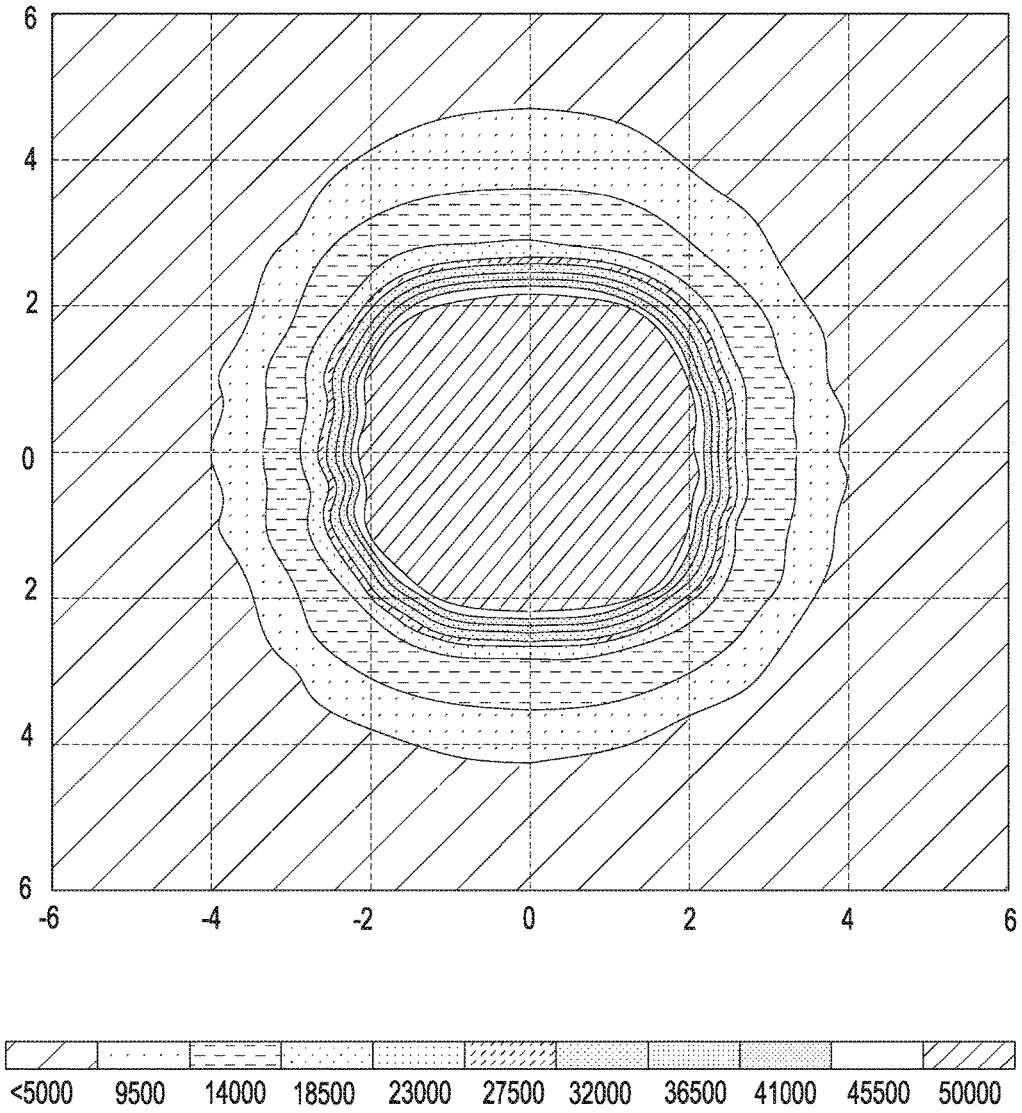
FIG. 16 is an intensity distribution of a light assembly using the lens of the present application.

Turning next to FIGS. 14 and 15, the beam pattern of projection lens 140 is described. Generally speaking, refraction is used to focus individual light rays to create a desired beam pattern. At the same time, the design of projection lens 140 allows a series of LED lights to achieve a substantially singular focused light intensity of approximately 200,000 candelas, as demonstrated in FIG. 16.

Protrusions 420 can comprise two types of lenses, either of which produces the effects described above. In a first embodiment, protrusions 420 comprise plano-convex lenses, wherein one side of the lens is curved and the other is flat. In the depicted embodiment, protrusion 420 is a solid semi-sphere wherein the side 430 nearest the light emitting diode 160 is flat and the opposite side 450 is curved. Stated differently, light travels from the flat side 430 of protrusion 420 to the curved side 450 of protrusion 420. The plano-convex lens converges or focuses collimated light travelling parallel to the lens axis and passing through the lens to a single focal point. The arrangement of the series of protrusions 420 described in the present application concentrates the light from each protrusion 420 to a single beam of light.

In a second embodiment, protrusions 420 take advantage of the theory of a Fresnel lens. Projection lens 140 is divided into a set of concentric annular sections known as "Fresnel zones". The outermost zone, marked as Z1 in FIG. 15, has the thickest lens. The overall thickness of the lens decreases in each subsequent zone, until reaching the convex center, C, which is nearly flat. At its thickest point, projection lens 140 is about 0.63 inches thick. The design of projection lens 140 allows a substantial reduction in the overall thickness of projection lens 140, which in turn reduces the volume of material required to produce projection lens 140.

One skilled in the art will understand that while Fresnel lenses and plano-convex lenses have been discussed separately, it is possible to include protrusions 420 comprising both Fresnel lenses and plano-convex lenses in a single projection lens 140.

A lighting system according to the present application has several advantages over existing lighting systems. The depicted device replaces a halogen light bulb in a lighting system with a plurality of light emitting diodes, allowing the lighting system to perform longer and undergo less part replacement. The present lighting system includes a projection lens which merges the beams of light from the plurality of light emitting diodes into a single beam of light. This single beam of light provides illumination equivalent to a halogen light. Further, the present lighting system houses the light emitting diodes in a compact, sealed housing assembly. Finally, the light assembly may include a tilt mechanism, providing the device with an ability to vertically tilt.

Figure 17:
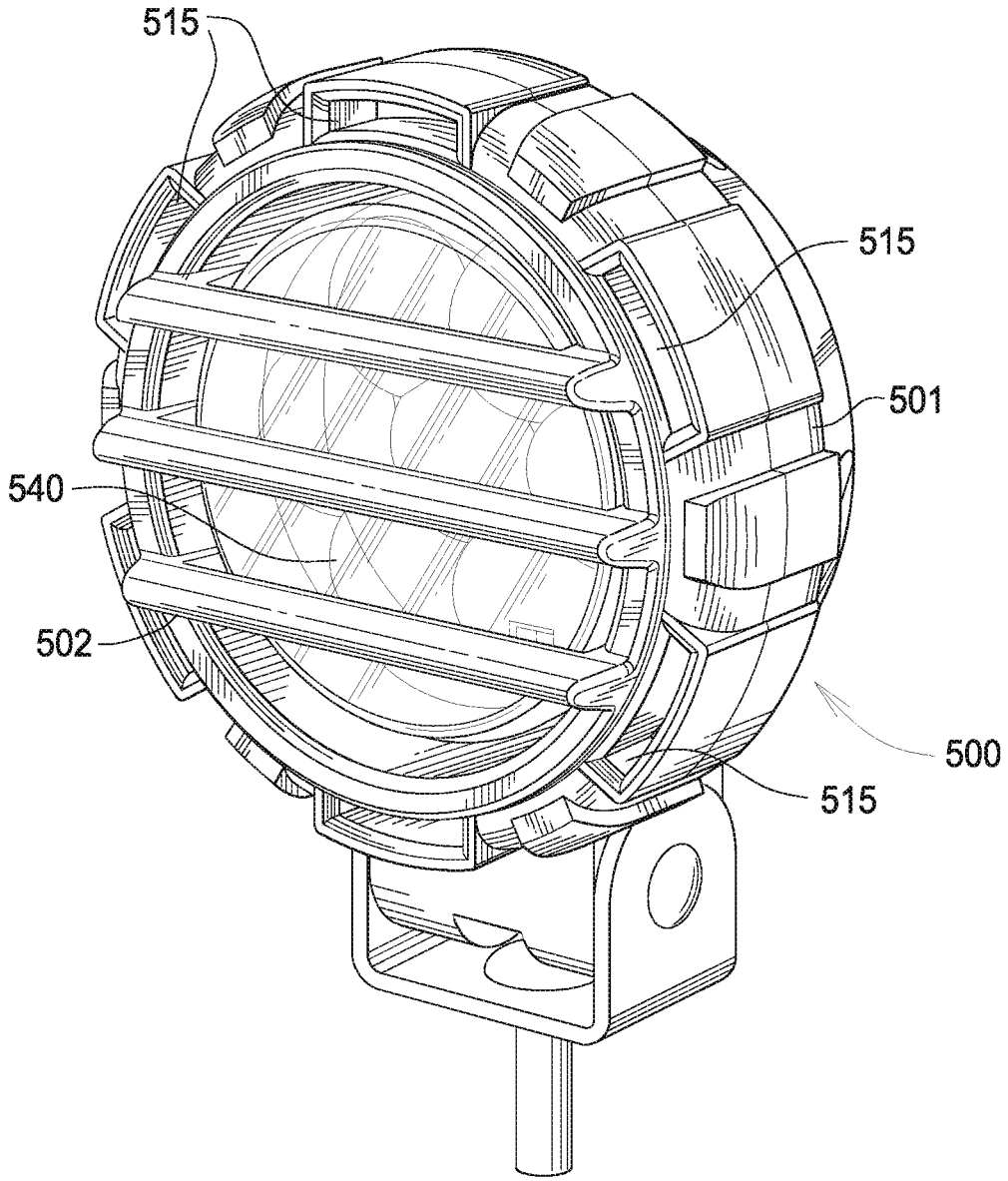
FIG. 17 is a front side perspective view of an alternate light housing.
Figure 18:
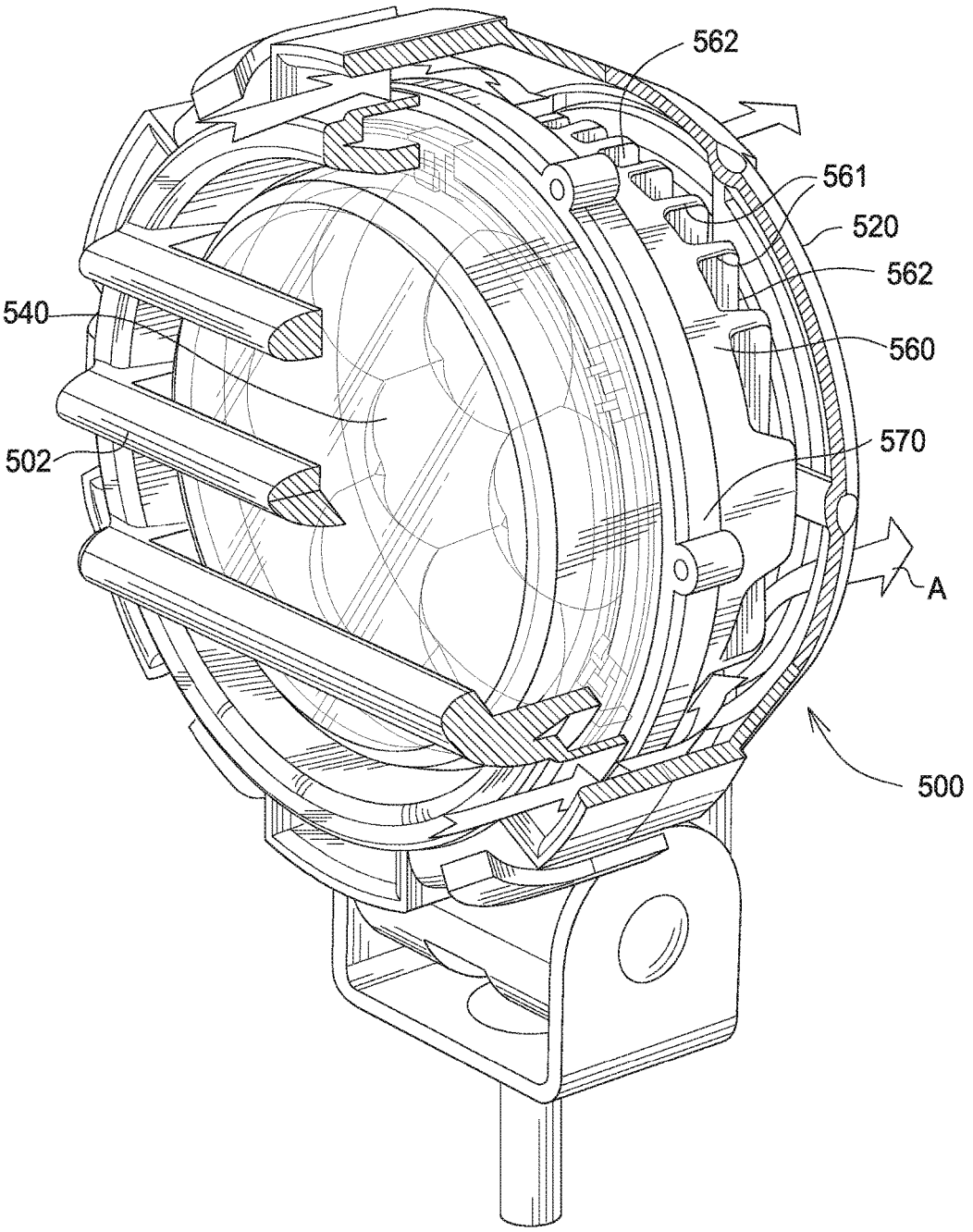
FIG. 18 is a partially cut away view of FIG. 17.
Figure 19:
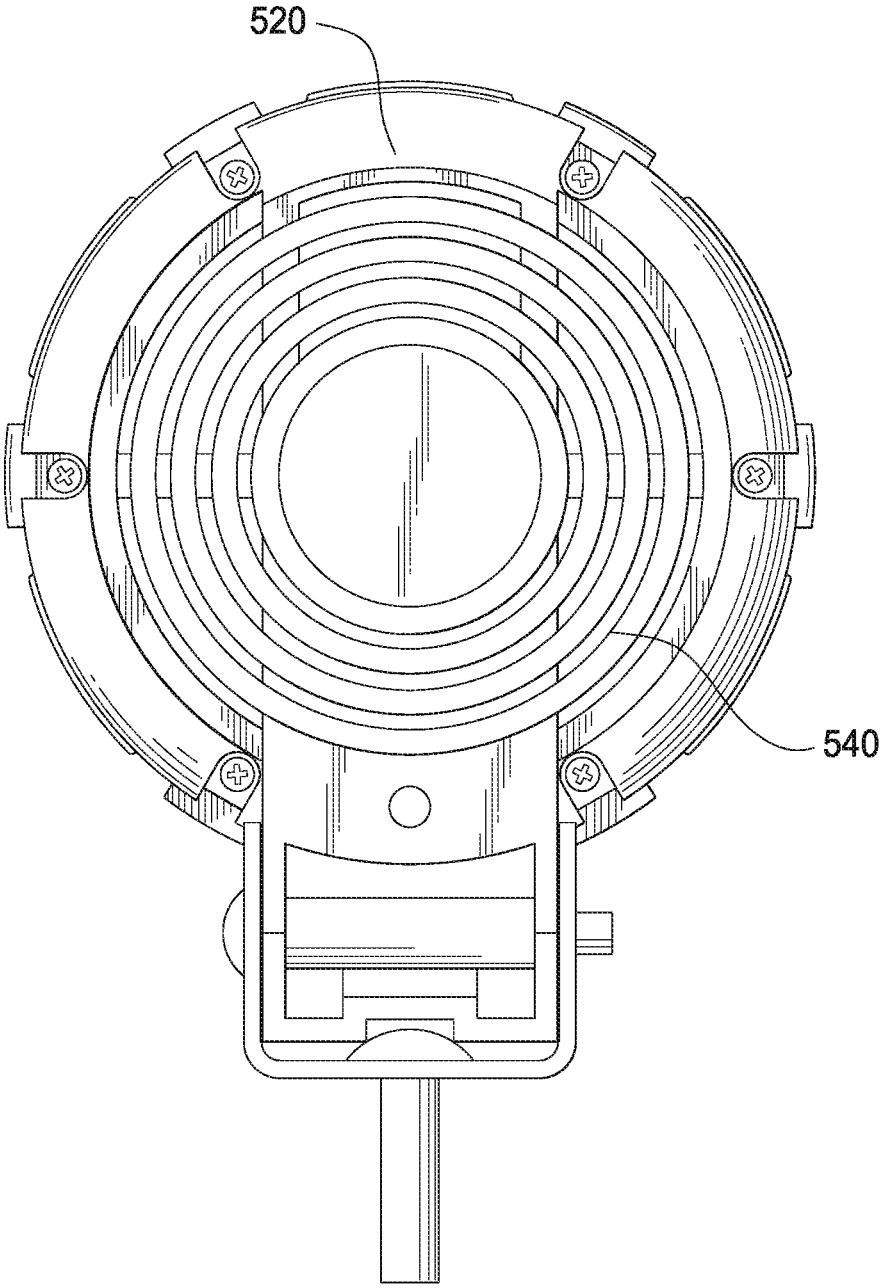
FIG. 19 is a back side perspective view of FIG. 17.

Another embodiment of the cooling fins and air current is shown in FIGS. 17 through 19. This second embodiment of air cooled light housing 500 has a round housing 510 with an optional rock guard 502. The housing could be other shapes other than round, no limitation is intended or should be inferred. The light housing 500 has a projection lens 540 that can be either of the types described above and functions as above to focus the individual LEDs into a single beam of light. The LED's are mounted on to heat sink 560 as described above. The heat sink has cooling fins 561 which extend across the back side of the heat sink, forming air channels 562. The projection lens 540 is mounted onto the heat sink by mounting bezel 570. In the depicted embodiment both the heat sink 560 and the mounting bezel 570 are made of aluminum. This allows the bezel to functions as a heat radiation surface for the heat sink. Those skilled in the art will understand that metal is selected for its heat dissipation properties. One having an ordinary level of skill in the art will understand that any material having similar properties to aluminum could be used.

The round housing 510 has air channels 515 spaced around the perimeter of the housing. As see in FIG. 18, the air channels 515 extend under the perimeter housing to the back side of the case 520 and over the air channels 561. When the light housing 500 is mounted on a vehicle, the movement of the vehicle forces air through the air channels 515 and then into air channels 562 on the heat sink as shown by arrows A in FIG. 18. The air then follow out the back side of the light through grill 540.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all combinations and subcombinations possible of the group are intended to be individually included in the disclosure.

In general the terms and phrases used herein have their art-recognized meaning, which can be found by reference to standard texts, journal references and contexts known to those skilled in the art. The above definitions are provided to clarify their specific use in the context of the invention.

The invention claimed is:

1. A light assembly for mounting to a base unit comprising:

a heat sink having a front, a back, a base and a top, with a plurality of cooling fins extending across at least the base, back, and top of the heat sink, and air channels formed between the cooling fins;

a plurality of LEDs arranged on the front of the heat sink;

a projection lens arranged over the plurality of LEDs, a first side of the projection lens being substantially flat and facing the plurality of LEDs, a second side of the projection lens having a plurality of protrusions; and a protective lens arranged over the projection lens;

wherein the ends of the air channels open towards and terminate adjacent to the protective lens;

wherein ambient air enters each air channel when the light assembly is in use and travels around the heat sink before exiting, thereby transferring heat away from the cooling fins.

2. The light assembly of claim 1, wherein the plurality of LEDs are mounted to printed circuit board (PCB).

3. The light assembly of claim 1, further comprising a bezel coupled to the heat sink, the bezel having one or more heat fins, wherein the air channels formed between the cooling fins of the heat sink continuously extend to form between the one or more heat fins of the bezel.

4. The light assembly of claim 1, further comprising an outer housing, the air channels formed between the plurality of cooling fins at least partially enclosed by the outer housing.

5. The light assembly of claim 1, further comprising a fan mounted adjacent to the base of the heat sink.

6. The light assembly of claim 1, further comprising bearings and a gear configured for vertical tilt of the light assembly through a range of at least 200 degrees when the light assembly is operatively mounted to a base unit.

7. The light assembly of claim 1, further comprising an accessory lens mounted to the bezel and arranged over the protective lens, the accessory lens selected from the group consisting of a flood lens, a color lens, and a rock guard.

8. The light assembly of claim 1, wherein each protrusion of the projection lens comprises a solid semi-sphere forming a plano-convex lens, one or more flattened edges are formed at abutting borders between the protrusions, the protrusions extend along at least two axes of the projection lens, each LED is positioned underneath approximately the center of one of protrusions, and the plurality of protrusions are configured to converge light rays into a concentrated beam of light when the light assembly is in use.

9. A light assembly for mounting to a base unit comprising:

a heat sink having a front, a back, a base and a top;

a plurality of cooling fins formed on the heat sink, the plurality of cooling fins defining air channels therebetween, the air channels extending over at least the base, the back, and the top of the heat sink;

a plurality of LEDs arranged on the front of the heat sink;

a projection lens arranged over the plurality of LEDs, a first side of the projection lens being substantially flat and facing the plurality of LEDs, a second side of the projection lens having a plurality of protrusions;

a protective lens positioned over the projection lens; and a bezel coupled to the heat sink, the bezel securing the protective lens in place;

wherein one or more air channels of the heat sink further extend between cooling fins at least partially formed on the bezel, the ends of the one or more air channels opening toward the protective lens;

wherein air enters each air channel when the light assembly is in use and travels around the heat sink before exiting, thereby transferring heat away from the cooling fins.

10. The light assembly of claim 9, wherein the plurality of LEDs are mounted to printed circuit board (PCB).

11. The light assembly of claim 9, further comprising an outer housing, the air channels between the plurality of cooling fins at least partially enclosed by the outer housing.

12. The light assembly of claim 9, further comprising a fan mounted adjacent to the base of the heat sink.

13. The light assembly of claim 9, further comprising bearings and a gear configured for vertical tilt of the light assembly through a range of at least 200 degrees when the light assembly is operatively mounted to a base unit.

14. The light assembly of claim 9, further comprising an accessory lens mounted to the bezel and arranged over the protective lens, the accessory lens selected from the group consisting of a flood lens, a color lens, and a rock guard.

15. The light assembly of claim 9, wherein each protrusion of the projection lens comprises a solid semi-sphere forming a plano-convex lens, one or more flattened edges are formed at abutting borders between the protrusions, the protrusions extend along at least two axes of the projection lens, each LED is positioned underneath approximately the center of one of protrusions, and the plurality of protrusions are configured to converge light rays into a concentrated beam of light when the light assembly is in use.

16. A light assembly comprising:

a heat sink having a front, a back, a base and a top;

a plurality of LEDs arranged on the front of the heat sink;

a projection lens arranged over the plurality of LEDs, a first side of the projection lens being substantially flat and facing the plurality of LEDs, a second side of the projection lens having a plurality of protrusions;

a protective lens positioned over the projection lens;

a bezel coupled to the heat sink, the bezel securing the protective lens in place;

a plurality of cooling fins defining a plurality of air channels therebetween, one or more air channels extending at least across the heat sink and the bezel and opening toward the protective lens; and an outer housing, the plurality of air channels at least partially enclosed by the outer housing;

wherein air enters an air channel at the bezel when the light assembly is in use and travels around the heat sink before exiting, thereby transferring heat away from the cooling fins;

wherein each LED is positioned underneath approximately the center of one of the protrusions, the protrusions extend along at least two axes of the projection lens, the protrusions configured to converge light rays into a concentrated beam of light when the light assembly is in use.

17. The light assembly of claim 16, wherein the plurality of LEDs are mounted to printed circuit board.

18. The light assembly of claim 16, further comprising a fan mounted adjacent to the base of the heat sink.

19. The light assembly of claim 16, further comprising bearings and a gear configured for vertical tilt of the light assembly through a range of at least 200 degrees.

20. The light assembly of claim 16, wherein each protrusion of the projection lens comprises a solid semi-sphere forming a plano-convex lens, and one or more flattened edges are formed at abutting borders between the protrusions.

* * * * *